US009979076B2

(12) United States Patent
Ngo Bui Hung et al.

(10) Patent No.: US 9,979,076 B2
(45) Date of Patent: May 22, 2018

(54) UMBILICAL ANTENNA STRUCTURE

(71) Applicant: THALES, Courbevoie (FR)

(72) Inventors: Frédéric Ngo Bui Hung, Gennevilliers (FR); Gilbert Multedo, Gennevilliers (FR)

(73) Assignee: THALES, Courbevoie (FR)

( * ) Notice: Subject to any disclaimer, the term of this patent is extended or adjusted under 35 U.S.C. 154(b) by 48 days.

(21) Appl. No.: 15/338,241

(22) Filed: Oct. 28, 2016

(65) Prior Publication Data

US 2017/0125893 A1 May 4, 2017

(30) Foreign Application Priority Data

Oct. 30, 2015 (FR) ..... 15 02291

(51) Int. Cl.

| | |
|---|---|
| ***H01Q 1/28*** | (2006.01) |
| ***H01R 24/40*** | (2011.01) |
| ***H01R 13/622*** | (2006.01) |
| ***H01Q 1/24*** | (2006.01) |
| ***H01Q 1/12*** | (2006.01) |
| *H01R 103/00* | (2006.01) |

(52) U.S. Cl.

CPC ..... *H01Q 1/28* (2013.01); *H01Q 1/1207* (2013.01); *H01Q 1/24* (2013.01); *H01R 13/622* (2013.01); *H01R 24/40* (2013.01); *H01R 2103/00* (2013.01)

(58) Field of Classification Search

CPC ..... H01Q 1/1207; H01Q 1/24; H01Q 1/28; H01R 13/622; H01R 2103/00; H01R 24/40; C07H 19/048

See application file for complete search history.

(56) References Cited

U.S. PATENT DOCUMENTS 2,578,836 A * 12/1951 Potter ..... H03H 7/482 348/E7.053
2,842,712 A * 7/1958 Muldoon ..... H03B 29/00 313/573
2,865,006 A * 12/1958 Sabaroff ..... H03H 7/0123 174/36
3,074,064 A * 1/1963 Pickles ..... H01Q 9/16 343/807
3,534,371 A * 10/1970 Seavey ..... H01Q 1/427 343/722

(Continued)

FOREIGN PATENT DOCUMENTS

FR 2 278 571 A1 2/1976
WO 2012/121015 A1 9/2012

*Primary Examiner* — Tho G Phan
(74) *Attorney, Agent, or Firm* — Baker & Hostetler LLP

(57) ABSTRACT

An antenna structure for a carrier connected to a station by a coaxial cable comprises at least the following elements: a break delimiting a first portion of length H1 and a second portion of length H2, forming a radiating element isolated from a second section by means of a current isolator, at the break, the core of the coaxial cable from the lower face of the break is connected to the braid of the coaxial cable from the upper face of the break and the core of the coaxial cable from the upper face of the break is connected to the braid of the coaxial cable from the lower face of the break, the first upper portion has a recess in the coaxial cable suited to inserting a short circuit for signals whose frequency is equal to the operating frequency.

12 Claims, 6 Drawing Sheets

(56) References Cited

U.S. PATENT DOCUMENTS

| | | | | |
|---|---|---|---|---|
| 3,564,551 | A * | 2/1971 | Mills et al. | H01Q 9/145 343/747 |
| 3,588,903 | A * | 6/1971 | Hampton | H01Q 9/28 343/749 |
| 3,899,787 | A * | 8/1975 | Czerwinski | H01Q 9/18 343/790 |
| 4,004,759 | A | 1/1977 | Hund | |
| 5,832,364 | A | 11/1998 | Gustafson | |
| 2002/0167702 | A1 | 11/2002 | Badesha et al. | |
| 2003/0222811 | A1 | 12/2003 | Halsey et al. | |
| 2005/0040991 | A1 | 2/2005 | Crystal | |
| 2014/0247193 | A1 | 9/2014 | Parsche | |
| 2015/0184639 | A1 | 7/2015 | Goessling et al. | |

* cited by examiner

UMBILICAL ANTENNA STRUCTURE

CROSS-REFERENCE TO RELATED APPLICATIONS

This application claims priority to foreign French patent application No. FR 1502291, filed on Oct. 30, 2015, the disclosure of which is incorporated by reference in its entirety.

FIELD OF THE INVENTION

The invention concerns a very high frequency and ultra-high frequency or V-UHF radiating system that allows a flying vehicle with which it is associated to be supplied with electric power. It concerns an umbilical antenna structure for a flying vehicle, such as a drone. The invention can be used in high-speed VHF/UHF radio systems. It is particularly used in (30-88 MHz) and (225-400 MHz) frequency ranges.

BACKGROUND

Flying vehicles such as drones are often fitted with antennas that allow signals to be transmitted or received. These vehicles also need to be supplied with power in order to operate. This supply can be provided by a battery with which the flying vehicle is equipped, but since said battery has a limited range, most of the time the vehicles are supplied by a cable carrying the power and connected to a terrestrial station.

Moreover, installing an antenna on the flying vehicle or the captive vehicle can lead to the vehicle being overdimensioned, and/or to flight instability. When the antenna is installed under the captive vehicle, it is then necessary for the bulk to be taken into consideration on the ground.

The patent FR 2 278 571 describes an example of a captive vehicle equipped with an antenna. FIG. 1 shows a flying vehicle A connected to a mobile terrestrial station B. The flying vehicle comprises a payload C, such as a camera, a radio device, an antenna, lift-producing blades D, D' and a tether cable E, known as a "tether", which allows the payload C to be connected to the terrestrial station and is not used to take electric power to the flying vehicle. The station has a winch T allowing the cable to be wound up and unwound, and a platform P for the flying vehicle to launch and land. In this example, the radiating element is separate from the supply cord.

Another example is provided in the patent application US 2002/0167702, which presents a dedicated physical link that is independent of the links necessary for the payload. The tether has wires carrying electric power.

The patent application US 2003/0222811 describes an antenna system connected by a cable or tether.

The prior art systems therefore have particularly the following disadvantages:

limited range if the power for ensuring that the vehicle is maintained in flight is onboard, for example the power supplied by a battery, inertial storage, overdimensioning of the vehicle taking into consideration the mass of the antenna and the mass of the supply cable.

There is currently a need to have a structure that allows both the radiating element function and the supply of power to the flying vehicle to be provided.

In the description that follows, the expressions "flying vehicle", "captive vehicle" and "carrier" are used indiscriminately to denote one and the same object connected to a station by a cable.

SUMMARY OF THE INVENTION

The structure according to the invention particularly has two functionalities, providing a radiating element functionality and a supply function for power that is necessary to the operation of a flying vehicle.

The invention concerns an antenna structure for a carrier connected to a station by a coaxial cable acting as a tether and power supply, said coaxial cable comprising a core and a braid, a first end connected to the station comprising a transceiver, a supply source and a second end of the coaxial cable is connected to the carrier, the antenna structure being characterized in that it has at least the following elements:

on at least a first cable section, the coaxial cable comprises a break delimiting a first upper cable portion of length H1 and a second lower cable portion of length H2, the two portions forming a radiating element, isolated from a second cable section by means of a current isolation device, at the break, the core of the coaxial cable from the lower face of the break is connected to the braid of the coaxial cable from the upper face of the break and the core of the coaxial cable from the upper face of the break is connected to the braid of the coaxial cable from the lower face of the break, the first upper cable portion has a recess or cavity in the coaxial cable, the geometry and the dimensions of the recess being adapted to insert a device acting as a short circuit for RF signals whose frequencies are equal to the operating frequencies of the antenna element.

For the central operating frequency value of the radiating element, the value of H1 is chosen to be equal to one quarter of the wavelength in air $\lambda/4$, the value of H3 is equal to one quarter of the wavelength $\lambda g/4$ in the dielectric constituting the coaxial cable, and the value H2 is equal to H1.

The current (power) isolation device is constituted by ferrite beads, for example.

According to one variant embodiment, the carrier is equipped with an axial connector mounted on an isolating frame adapted to a coaxial connector fitted to the upper end of the coaxial cable of the antenna structure.

The station may have a winch for winding up the coaxial cable and a swivel joint integral with the winch adapted to provide an electrical link and a radio link while the cable is being wound up.

According to one variant embodiment, the core of the coaxial cable at the lower face of the break is connected to the braid of the coaxial cable at the upper face of the break by means of a device comprising an impedance transformer and the core is galvanically isolated from the lower face by a capacitance.

According to another variant embodiment, the braid of the coaxial cable at the lower face of the break is connected via an inductor to the core of the coaxial cable at the upper face of the break.

The current isolation device is, by way of example, constituted by a winding of the coaxial cable around a flexible core.

The station may have a coupler to the antenna structure, and the coupler is characterized in that it is constituted by a high pass filter in series with a first input of the coupler and a low pass filter in series with a second input of the coupler, an output connected to the end of the cable.

The high pass filter is, by way of example, constituted by a T network made up of two capacitances and an inductance, and the low pass filter is a T network made up of two inductances and a capacitance.

According to one variant embodiment, the antenna element is suited to operating at very high frequency VHF or ultra-high frequency UHF.

The invention also concerns a device having an antenna structure according to the invention, said antenna structure being associated with, tethered to, a captive flying vehicle situated at a given altitude in relation to a terrestrial station.

BRIEF DESCRIPTION OF THE DRAWINGS

Other features and advantages of the present invention will become more apparent on reading the description that follows for exemplary embodiments provided by way of illustration and without applying any limitation, to which the figures are appended, in which.

DETAILED DESCRIPTION

Figure 1:
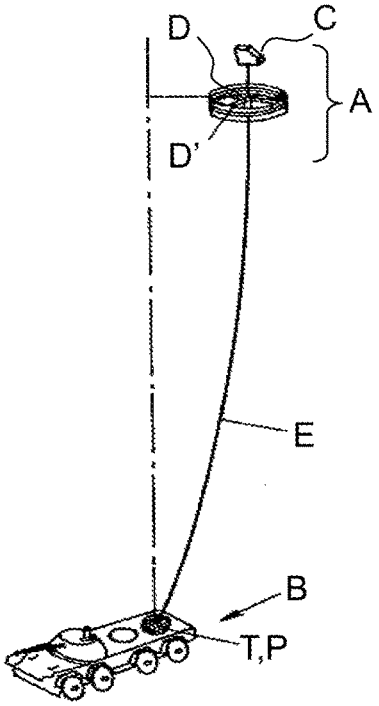
FIG. 1 shows an example of an antenna structure according to the prior art.
Figure 2:
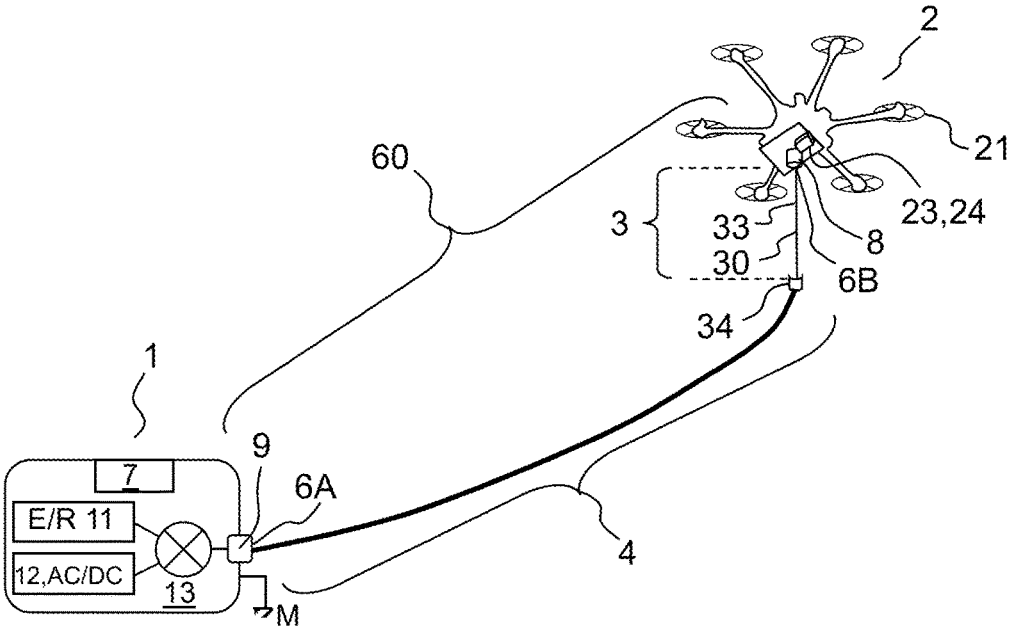
FIG. 2 shows a representation of the unfurling of an antenna system according to the invention.

FIG. 2 shows an example of deployment of an antenna system according to the invention. A mobile terrestrial station 1 is linked to a captive vehicle 2 by virtue of an antenna system 60 according to the invention. The terrestrial station has a parking platform 7 and a winch 9 to which a first end 6A of the antenna system is attached. A second end 6B of the antenna system is attached to the captive vehicle by suitable means 8. The antenna structure 60 shown in detail in FIG. 3 has a first portion 4 that particularly allows the captive vehicle to be supplied with power and a second portion 3 corresponding to a radiating element comparable to an antenna in terms of its functionality. The antenna structure 60 according to the invention that will be described is used as an RF supply cable, taking the radio-frequency power from a transceiver set 11 situated on the terrestrial station 1 to the radiating element elevated in relation to the terrestrial station. It also takes the electric power from a power source 12 situated on the mobile terrestrial station 1. The power source 12 may be a DC or AC power source.

The captive vehicle 2 has, by way of example, one or more lift-producing motors 21, a decoupling device 23 and a two-wire power supply cable 24.

The antenna system according to the invention particularly comprises a coaxial tether cable comprising a break 30, an earthing capacitance 33 and a device 34 acting as a current (or power) isolator for the radiating element 3, the isolator being arranged between the first portion 4 and the second portion 3. The single tether cable 6 supplies the captive vehicle 2 with electric power and transports the RF power on just two conductive wires. The capacitance 33 acts as a short circuit for RF signals whose frequencies are equal to the operating frequencies of the antenna.

Figure 3:
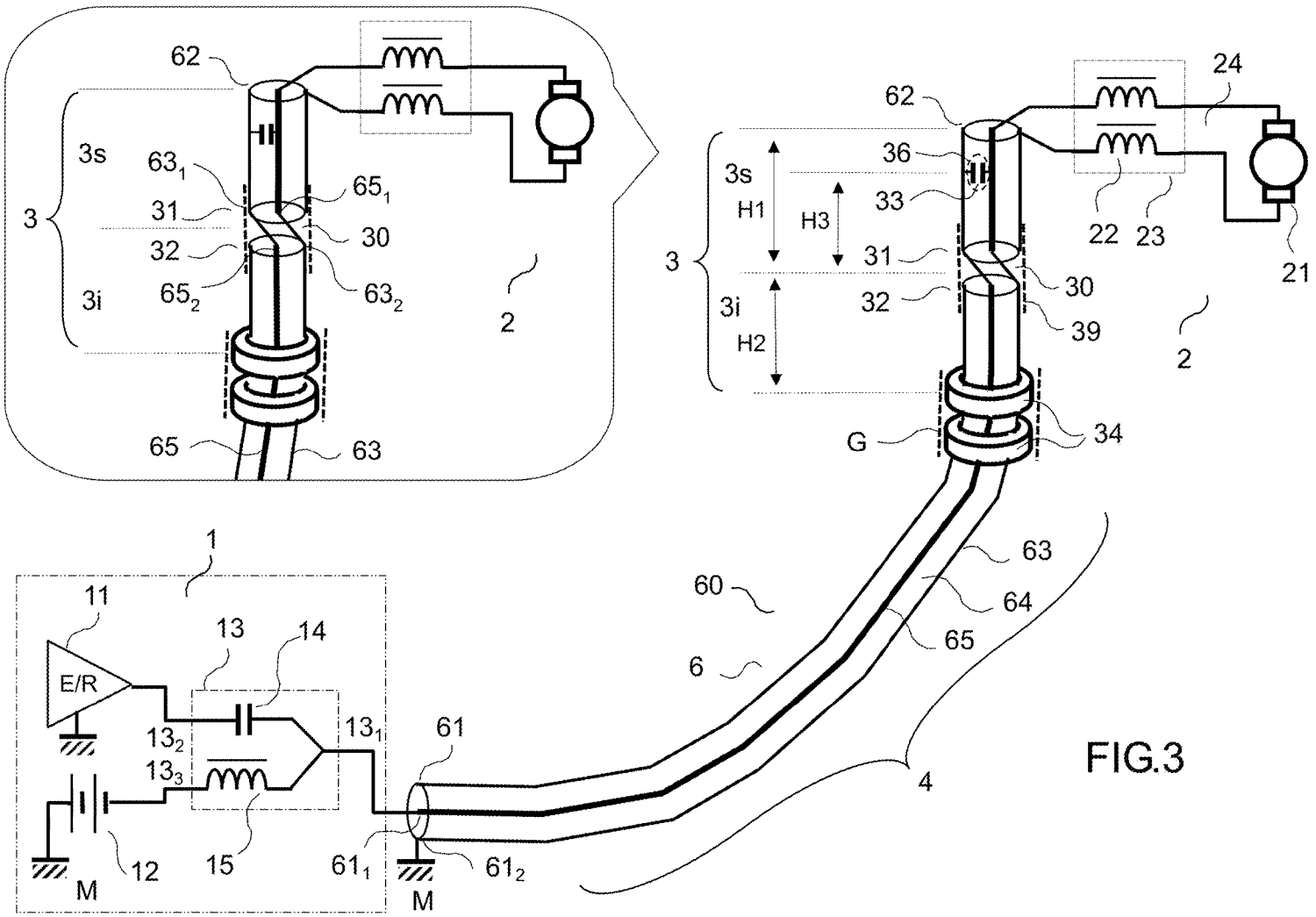
FIG. 3 shows an exemplary embodiment of the antenna and power supply structure.

FIG. 3 shows a detailed view of the various elements and modules making up the antenna structure according to the invention.

The captive vehicle 2, for example a microdrone of hexacopter type, has one or more electric motors 21 to lift it that are powered from an electrical link using a wired cable 24 provided with radio isolation by a decoupling device 23 that is known to a person skilled in the art, for example a winding 22 around a magnetic core, which is not explained in order to simplify the description.

The terrestrial station 1 comprises, by way of example, a radio transceiver set 11 preferably operating in the VHF or UHF frequency bands (30 MHz to 3 GHz) and a DC or AC source of electric power 12. The output 11*s* of the transceiver 11 is connected to a first input $\mathbf{13}_2$ of the coupler 13. The coupler 13 is constituted by a high pass filter depicted by a capacitance 14 arranged in series with the RF input $\mathbf{13}_2$ and a low pass filter represented by an inductor 15 in series with a second input $\mathbf{13}_3$ of the coupler 13.

The coaxial cable 6 acting as a tether cable has a braid made of electrically conductive wire 63 forming a sheath, a conductive core 65 and a dielectric material 64 filling the space between the sheath 63 and the core 65, a first lower end 61 of the coaxial cable 6 being connected to the coupler 13 by connecting a first end $\mathbf{61}_1$ of the core 65 to the output $\mathbf{13}_1$ of the coupler 13 and a second end $\mathbf{61}_2$ of the sheath 63 to the earth M of the system. The second end 62 or upper end of the cable is connected to a decoupling device 23 situated on the captive vehicle 2. The cable can be wound up onto a winch (9, FIG. 2).

The antenna structure according to the invention is made up of the coaxial cable 6 in which a break 30 will be made, which will allow a polarity inversion to be obtained, and the portion acting as radiating element will be isolated.

In FIG. 3, the portion of the cable acting as radiating element bears the reference 3. It is obtained by producing a break 30 in the coaxial cable 6. The break 30 is, by way of example, protected and mechanically held by a sleeve 39. The section 3 forming the radiating element is delimited by a current or power isolation device 34 known to a person skilled in the art. The section 3 forming the radiating element is constituted by a first lower element 3*i* situated between the break 30 and the current isolation element 34, and a second upper element 3*s* situated between the top of the break 30 and the upper end 62 of the coaxial cable 6.

The upper portion 3*s* has a length H1 and the lower portion 3*i* has a length H2. The value of H2 is preferably equal to the value H1.

On the portion 3 forming the radiating element, the core 65 of the coaxial cable 6 at the lower face 32 of the break 30 is connected to the braid 63 of the coaxial cable at the upper face 31 of the break corresponding to the lower face of the element 3*s*, and the core 65 of the coaxial cable from the upper face 31 of the break 30 is connected to the braid 63 of the coaxial cable from the lower face 32 of the break 30. The break 30 serves to invert the conductors, the core 65 from the bottom being connected at a point $\mathbf{65}_2$ to a point $\mathbf{63}_1$ of the braid 63 from the top and, conversely, the core from the top being connected at a point $\mathbf{65}_1$ to the point $\mathbf{63}_2$ of the braid from the bottom.

The value of H1 is preferably chosen to be equal to one quarter of the wavelength of the central operating frequency, $\lambda/4$, where $\lambda$ is the wavelength in air.

In order to produce the isolation between the radiating element 3 and the second portion 4 of the coaxial cable, there are one or more beads 34 made of ferromagnetic material, for example of ferrite, that are held by a flexible sheath G. The beads are preferably unjointed in order to retain flexibility for the cable at this point, so as to isolate the radiating section from the remainder of the cable.

At the upper portion 3*s* of the section of the radiating element, at a distance H3 from the break 30, a recess 36 is made in the cable 6 in order to position a capacitance 33 whose value is chosen in order to produce a short circuit for RF signals at this point. Any other device that is able to provide a short-circuit function but that guarantees current isolation, for example an open-circuit quarter-wave line, can be used instead of the capacitance. The distance H3 is preferably equal to one quarter of the wavelength in the dielectric, λg/4.

Figure 4:
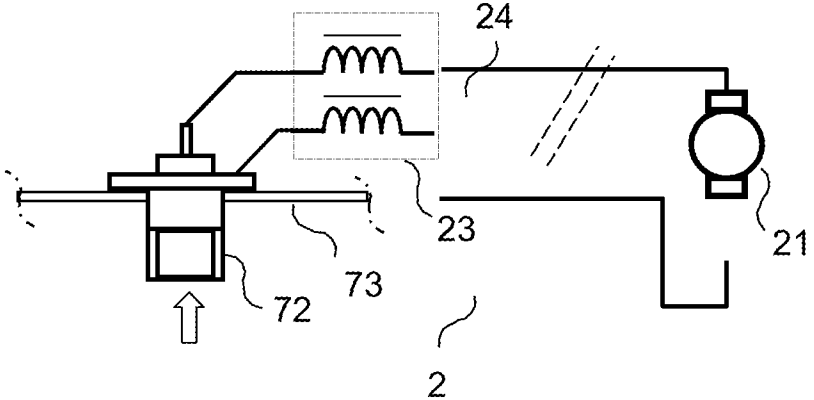
FIG. 4 shows a first variant embodiment of the connection.
Figure 4:
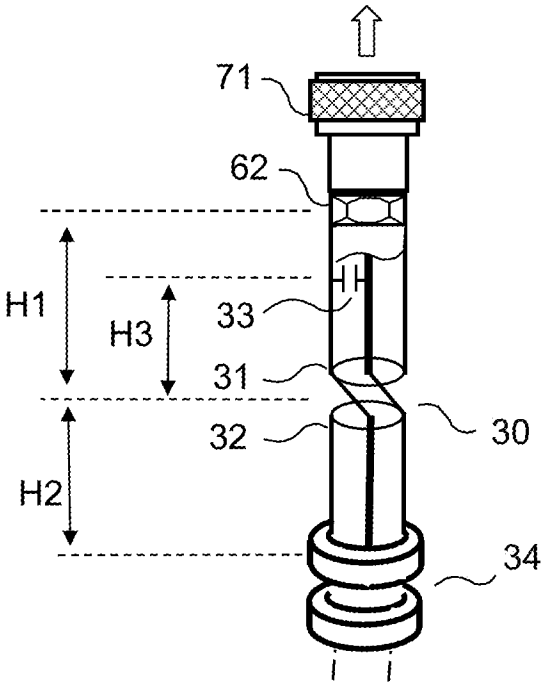

FIG. 4 shows a variant embodiment in order to produce the connection for the antenna structure according to the invention at the flying vehicle.

The upper end 62 of the coaxial cable 6 is fitted with a standard coaxial connector 71 known to a person skilled in the art, for example an N-type connector shown in the figure, in order to provide a mechanical link and an electrical connection to the flying vehicle 2.

The flying vehicle 2 has a complementary coaxial connector 72 mounted on an isolating frame 73 of said flying vehicle and connected directly to the decoupling device 23.

Figure 5:
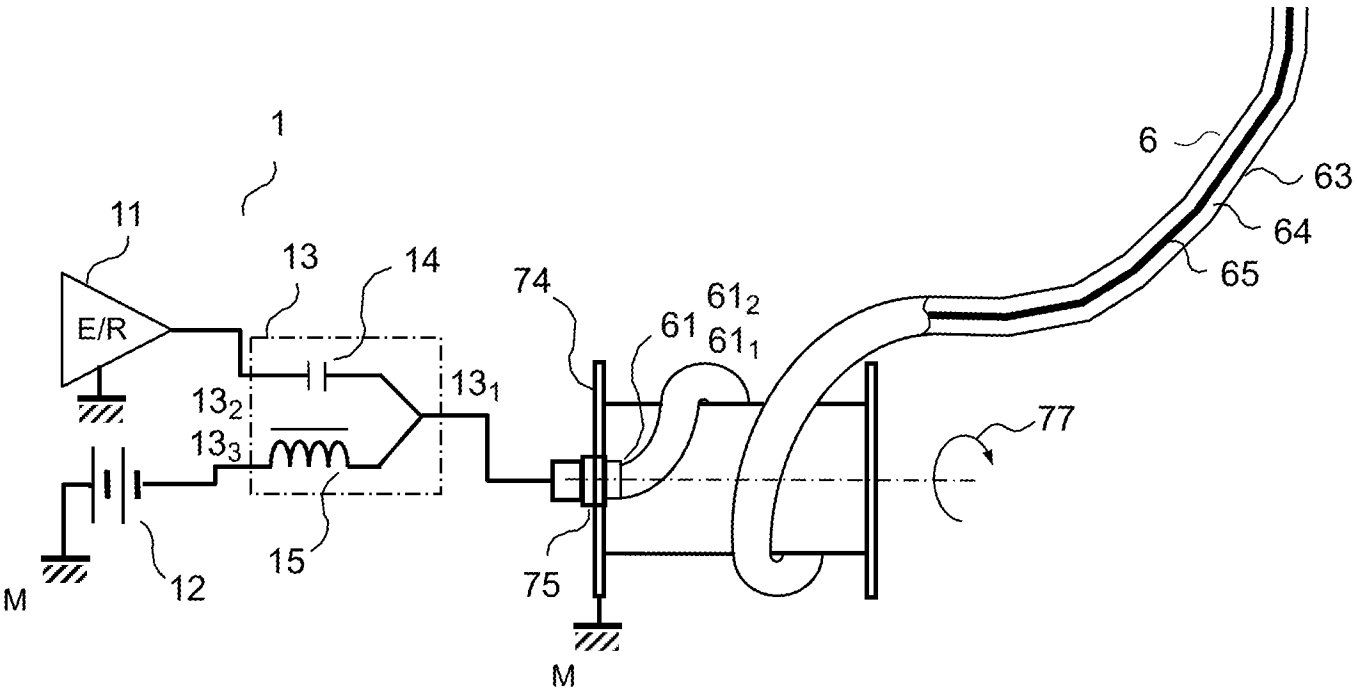
FIG. 5 shows a means for winding up the cable.

FIG. 5 shows another variant for the connection of the coaxial cable at the terrestrial station 1. In this example, the end 61 is connected to a coaxial swivel joint 75 integral with a winch 74 rotating about an axis 77 and allowing the radio and electrical link while the cable 6 is being wound up. This solution is simple and inexpensive.

Figure 6:
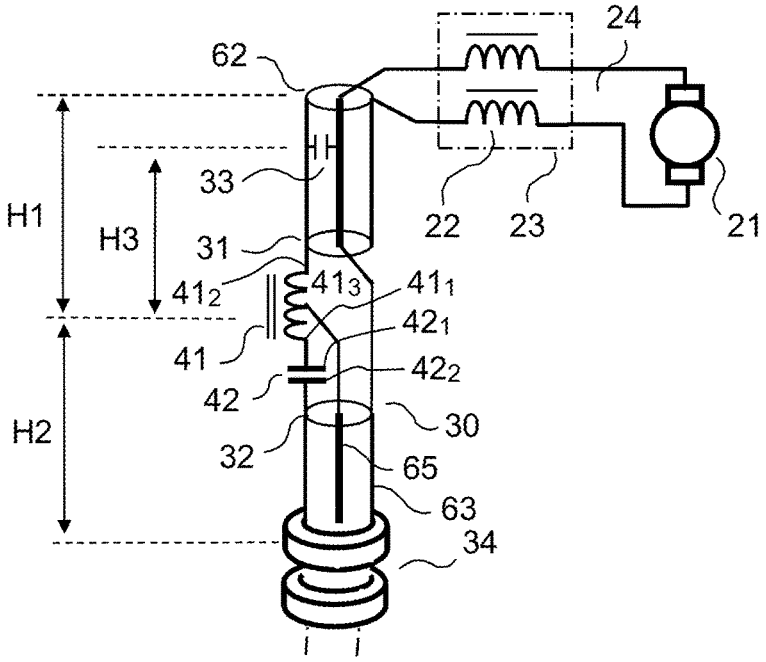
FIG. 6 shows a structure example allowing the bandwidth to be widened.

FIG. 6 provides an exemplary embodiment allowing the usable bandwidth to be widened. At the break 30, the connection 31 is made via an impedance transformer 41 that is known to a person skilled in the art and galvanically isolated from 32, for example by means of a capacitance 42, a first terminal $\mathbf{42}_1$ of which is connected to a terminal $\mathbf{41}_1$ of the impedance transformer and a second terminal $\mathbf{42}_2$ of which is connected to the braid 63 of the portion 3*i* of the radiating element. The second terminal $\mathbf{41}_2$ of the impedance transformer 41 is connected to the braid 63 of the upper portion 3*s* of the radiating element. The impedance transformer 41 is linked to the core 65 of the second section 4 and at a midpoint $\mathbf{41}_3$.

Figure 7:
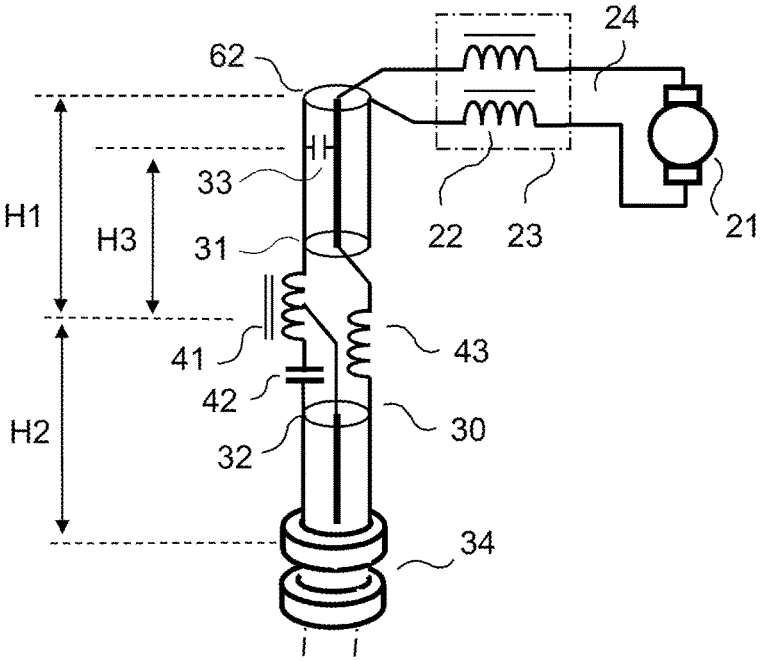
FIG. 7 shows a variant embodiment of the structure from FIG. 6.

FIG. 7 is a variant embodiment of FIG. 6 in which the braid of the coaxial cable at the lower face 32 of the break 30 is connected via an inductor 43 to the core of the coaxial cable at the upper face 31 of the break.

Figure 8:
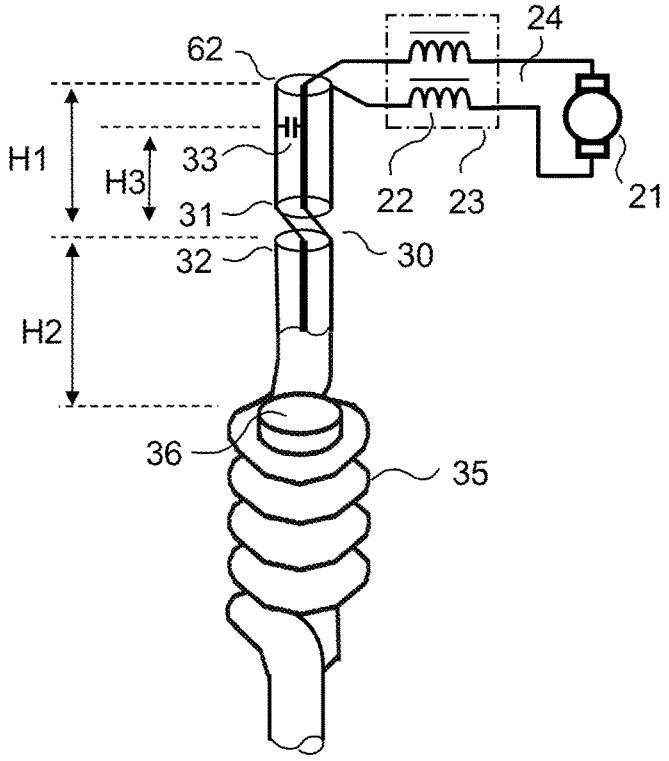
FIG. 8 shows an alternative for producing the isolation between the radiating element and the remainder of the coaxial cable.

FIG. 8 shows a variant in order to produce the current isolator 34. The ferrite beads 34 are replaced by a winding 35 of the coaxial cable 6 around a flexible core 36. The flexible core is, by way of example, made of dielectric material or of magnetic material.

Figure 9:
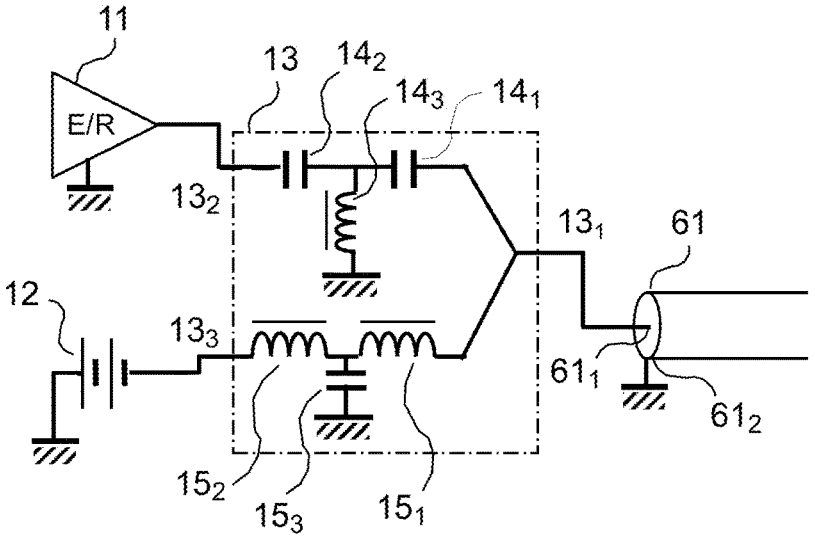
FIG. 9 shows a variant for the coupler of the flying vehicle.

FIG. 9 shows a variant in order to produce the coupler so as to maintain good impedance matching presented to the transceiver. In this example, the high pass filter uses a T network made of two capacitances $\mathbf{14}_1$, $\mathbf{14}_2$ and of an inductance $\mathbf{14}_3$, and the low pass filter made up of two inductances $\mathbf{15}_1$, $\mathbf{15}_2$ and of a capacitance $\mathbf{15}_3$ also uses a T network.

ADVANTAGES

The antenna structure according to the invention notably allows the radio range to be increased by raising the height of the radiating element or antenna of the radio communication system particularly for the VHF or UHF frequency band (30-88 MHz) and (225-400 MHz). It allows an RF power from the V-UHF band to be radiated by the cord for supplying electric power to a captive flying vehicle.

The structure has a low mass, thus enabling it to be lifted by a flying microvehicle, such as a hexacopter. As the coaxial cable is a flexible cable, it can easily be wound up onto a winch while remaining connected for the use of a suitable joint.

The invention claimed is:

1. An antenna structure for a carrier connected to a station by a coaxial cable acting as a tether and power supply, said coaxial cable comprising a core and a braid, a first end connected to the station comprising a transceiver, a supply source and a second end connected to the carrier, wherein the antenna structure has at least the following elements:

on at least a first section, the coaxial cable comprises a break delimiting a first upper portion of length H1 and a second lower portion of length H2, the first upper portion and the second lower portion forming a radiating element, isolated from a second section by means of a current isolation device, at the break, the core of the coaxial cable from the lower face of the break is connected to the braid of the coaxial cable from the upper face of the break and the core of the coaxial cable from the upper face of the break is connected to the braid of the coaxial cable from the lower face of the break, the first upper portion has a recess in the coaxial cable suited to inserting a short-circuit device for signals whose frequencies are equal to the operating frequency of the antenna structure.

2. The antenna structure according to claim 1, wherein at the central operating frequency of the radiating element, the value of H1 is chosen to be equal to one quarter of the wavelength in air λ/4, H3 is equal to one quarter of the wavelength λg/4 in the dielectric constituting the coaxial cable and H2 is equal to H1.

3. The antenna structure according to claim 1, wherein said current isolation device is constituted by ferrite beads.

4. The antenna structure according to claim 1, wherein the carrier is equipped with an axial connector mounted on an isolating frame adapted to a coaxial connector fitted to the upper end of the coaxial cable of the antenna structure.

5. The antenna structure according to claim 1, wherein the station has a winch for winding up the coaxial cable and a swivel joint integral with the winch adapted to providing an electrical link and a radio link while the cable is being wound up.

6. The antenna structure according to claim 1, wherein the core of the coaxial cable at the lower face of the break is connected to the braid of the coaxial cable at the upper face of the break by means of a device comprising an impedance transformer and galvanically isolated from the lower face by a capacitance.

7. The antenna structure according to claim 6, wherein the braid of the coaxial cable at the lower face of the break is connected via an inductor to the core of the coaxial cable at the upper face of the break.

8. The antenna structure according to claim 1, wherein the current isolation device is constituted by a winding of the coaxial cable around a flexible core.

9. The antenna structure according to claim 1, wherein the station has a coupler to the antenna structure, said coupler being constituted by a high pass filter in series with a first input of the coupler and a low pass filter in series with a second input of the coupler, an output connected to the end of the cable.

10. The antenna structure according to claim 9, wherein the high pass filter is constituted by a T network made up of two capacitances and an inductance, and the low pass filter is a T network made up of two inductances and a capacitance.

11. The antenna structure according to claim 1, wherein the antenna element is adapted to operate at very high frequency VHF or ultra-high frequency UHF.

12. A device comprising an antenna structure according to claim 1 that is associated with a captive flying vehicle situated at a given altitude in relation to a terrestrial station.

* * * * *